United States Patent [19]

Schwendemann et al.

[11] Patent Number: 4,880,060

[45] Date of Patent: Nov. 14, 1989

[54] VALVE CONTROL SYSTEM

[75] Inventors: Kenneth L. Schwendemann, Lewisville; Timothy J. Noack, Grapevine, both of Tex.

[73] Assignee: Halliburton Company, Duncan, Okla.

[21] Appl. No.: 238,741

[22] Filed: Aug. 31, 1988

[51] Int. Cl.[4] ..... E21B 7/12; E21B 34/04

[52] U.S. Cl. ..... 166/336; 166/319; 166/363; 166/368

[58] Field of Search ..... 166/336, 338, 340, 363, 166/365, 368, 319, 322, 323

[56] References Cited

U.S. PATENT DOCUMENTS

| | | | |
|---|---|---|---|
| 3,921,500 | 11/1975 | Silcox | 166/338 |
| 4,234,043 | 11/1980 | Roberts | 166/336 |
| 4,347,900 | 9/1982 | Barrington | 166/380 |
| 4,494,609 | 1/1985 | Schwendemann | 166/336 |
| 4,497,369 | 2/1985 | Hurta et al. | 166/368 |
| 4,522,370 | 6/1985 | Noack et al. | 251/63.5 |
| 4,636,934 | 1/1987 | Schwendemann et al. | 166/336 |
| 4,640,363 | 2/1987 | Taylor | 166/317 |
| 4,693,315 | 9/1987 | Taylor | 166/336 |

FOREIGN PATENT DOCUMENTS

| | | |
|---|---|---|
| WO82/03887 | 11/1982 | PCT Int'l Appl. . |
| 2089399 | 6/1982 | United Kingdom . |

*Primary Examiner*—Stephen J. Novosad
*Assistant Examiner*—Terry Lee Melius
*Attorney, Agent, or Firm*—James R. Duzan; Roland O. Cox

[57] ABSTRACT

A hydraulic control system for controlling a retainer valve in an underwater well test system. The control system is contained in a housing in the test string above the retainer valve. The control system and valve are operated by a surface control manifold via control conduits extending between the manifold and control system housing. The system provides opening and closing and very quick closure of the retainer valve by eliminating the requirement for closing pressure to be conducted through a long conduit from surface and by utilizing well pressure to close the valve and lock the valve closed. One embodiment of the control system requires a pressure pulse from surface to start quick retainer valve closure. Another embodiment of the control system monitors control conduits for loss of pressure while the retainer valve is open and automatically closes the valve on loss of control pressure. This control system permits killing fluid to be pumped through the retainer valve into the well after automatic closure or control system operation to reopen the valve and monitor.

20 Claims, 5 Drawing Sheets

VALVE CONTROL SYSTEM

BACKGROUND OF THE INVENTION

1. Field of the Invention

The present invention relates to hydraulic systems for controlling the operation of valves. This invention more specifically relates to a control system utilized to control a retainer valve in an underwater well test system.

2. Background Art

U.S. Pat. No. 4,693,315 to Frank H. Taylor discloses a well test system which includes a hydraulically controlled retainer valve in the upper section of the test pipe string.

An electro/hydraulic control system for controlling remotely located valves is disclosed in U.S. Pat. No. 4,636,934, which is incorporated herein for reference. This elaborate system controls a number of remote valves in a well test system for underwater wells. The control system also measures various well parameters and analyzes the measurements for preprogrammed considerations to control remotely located valves for optimum operation of the test system.

Retainer valves are used above a subsea test tree in the upper section of the string of pipe lowered into a well to conduct formation evaluating flow tests.

Before starting test operations in a well, the retainer valve is usually closed to seal pressure from above and permit all test string connections from the retainer valve to surface to be pressure tested. After pressure testing, retainer valves are reopened to permit flow through the test string while testing.

The primary function of the retainer valve is to close before the upper section of the test string is quickly disconnected from the rest of the test string during emergency conditions. The closed retainer valve retains water polluting liquids in the upper test string section and prevents discharge of these liquids into surrounding water. The closed retainer valve also prevents discharge of pressurized fluids downward from the upper test string section on disconnect with possible resulting rapid jet assisted upward movement of the string section which could cause injury or property damage.

Previous hydraulic control systems included control conduits connected to a pressure source on the surface. These conduits extended from the surface pressure source possibly thousands of feet downwardly to conduct pressured fluid to valves in well test strings to open or close the valves as required during well test operations. Because of the long lengths and small size of these conduits, along with high viscosity of pressurized control liquids pumped through the conduits, liquids in sufficient quantities necessary to close or open hydraulically operated valves require long periods of time to travel from surface to a valve and operate the valve. As retainer valves are sometimes closed because of emergency conditions which develop during well testing, quick closure is very desirable.

SUMMARY OF THE INVENTION

The retainer valve controlled by the invention control system is a ball type valve rotated between open and closed positions by a longitudinally moveable pressure responsive piston similar to the valve shown in U.S. Pat. No. 4,522,370 to Noack and Rathie. This valve is internally biased toward open position and when closed, continuous application of closing pressure hydraulically locks the valve closed. When not locked, the force of high pressure above the closed valve ball in this valve will force the ball downwardly and open to permit kill fluids to be pumped downwardly through the retainer valve and test string into the well.

The hydraulic control system of this invention provides quick closure of an hydraulically operated valve by eliminating the long control conduit from surface which usually delivers pressurized closing fluid to the valve. The downhole control system utilizes well pressure in the test string to close the valve. The invention control system provides the operator with the capability of opening the retainer valve by pressurizing fluid in an opening control conduit at the surface and closing the retainer valve to seal pressure from above by pressurizing fluid in a closing control conduit at the surface as required. One embodiment of the control system of the present invention provides quick retainer valve closure by manually opening a shut-off valve at surface to transmit a pressure pulse from a high pressure accumulator down a conduit to close a pilot valve in a control housing in the test string. The closed pilot valve directs well pressure from the test string through flow passages in the housing and conduits to close the retainer valve and lock the valve closed.

Another embodiment of the invention control system utilizes a number of pilot valves, pilot operated check valves and an accumulator housed in the downhole control housing and numerous flow passages in the control housing and conduits to open, close and lock or quick close and lock the retainer valve closed. This control system embodiment also provides pressure monitoring of conduits from surface, quick automatic closure of the retainer valve, reopening of the retainer valve or pumping kill fluids through the retainer valve into the well before reopening. When the retainer valve is open, the control system monitors the control conduits to surface for pressure loss. The control system will sense loss of pressure in damaged control conduits and will automatically operate the retainer valve to quickly close and hydraulically lock the valve closed. When the valve closes, well pressure is trapped in the control housing accumulator. This pressure is utilized later to operate the control system to reopen the retainer valve. The automatically closed valve may be pumped open with high pressure above the valve and killing fluid may be pumped through the valve and test string into the well to kill the well. After pumping kill fluid or re-establishing control line integrity after automatic retainer valve closure, the control system may be operated to reopen the retainer valve.

The control conduits are connected to a pressure source on the surface, extend down the annulus between the test string and riser and are connected into control circuitry in the housing near the retainer valve in the upper test string section. The valve opening and closing conduits extend from the control housing to the retainer valve and the housing control circuitry is in pressure communication with the well test string and liquids in the riser annulus.

Either embodiment of the control system of this invention may be used to control any similar hydraulically operated valve.

An object of this invention is to provide a well test system which includes a retainer valve control system which will normally open and close the retainer valve.

An object of this invention is to provide a well test system which includes a retainer valve control system which will quickly close the retainer valve and lock the valve closed.

Another object of this invention is to provide a well test system having a retainer valve control system which will operate and unlock the retainer valve after closing on reduction of pressure above the retainer valve.

An object of this invention is to provide a well test system having a control system and a retainer valve which after closing will permit killing fluids to be pumped down the test string through the retainer valve into the well.

Another object of this invention is to provide a valve control system which monitors pressure in control conduits from surface when the valve is open and automatically utilizes well pressure to quickly close a valve in the well pipe string on loss of pressure in the control conduits.

Another object of this invention is to provide a control system for controlling a valve in a pipe string in a well which utilizes well pressure for quickly closing the valve.

Another object of this invention is to provide a valve control system housed in a well pipe string which does not require pressurized fluid to be pumped long distances from the surface for closing a valve.

An additional object of this invention is to provide a valve control system which after operating to close a valve, will initiate valve reopening.

An object of this invention is to provide a well test system having a retainer valve control system which also may initiate disconnect of a subsea test tree in the well test string.

DESCRIPTION OF THE PREFERRED EMBODIMENTS

Figure 1:
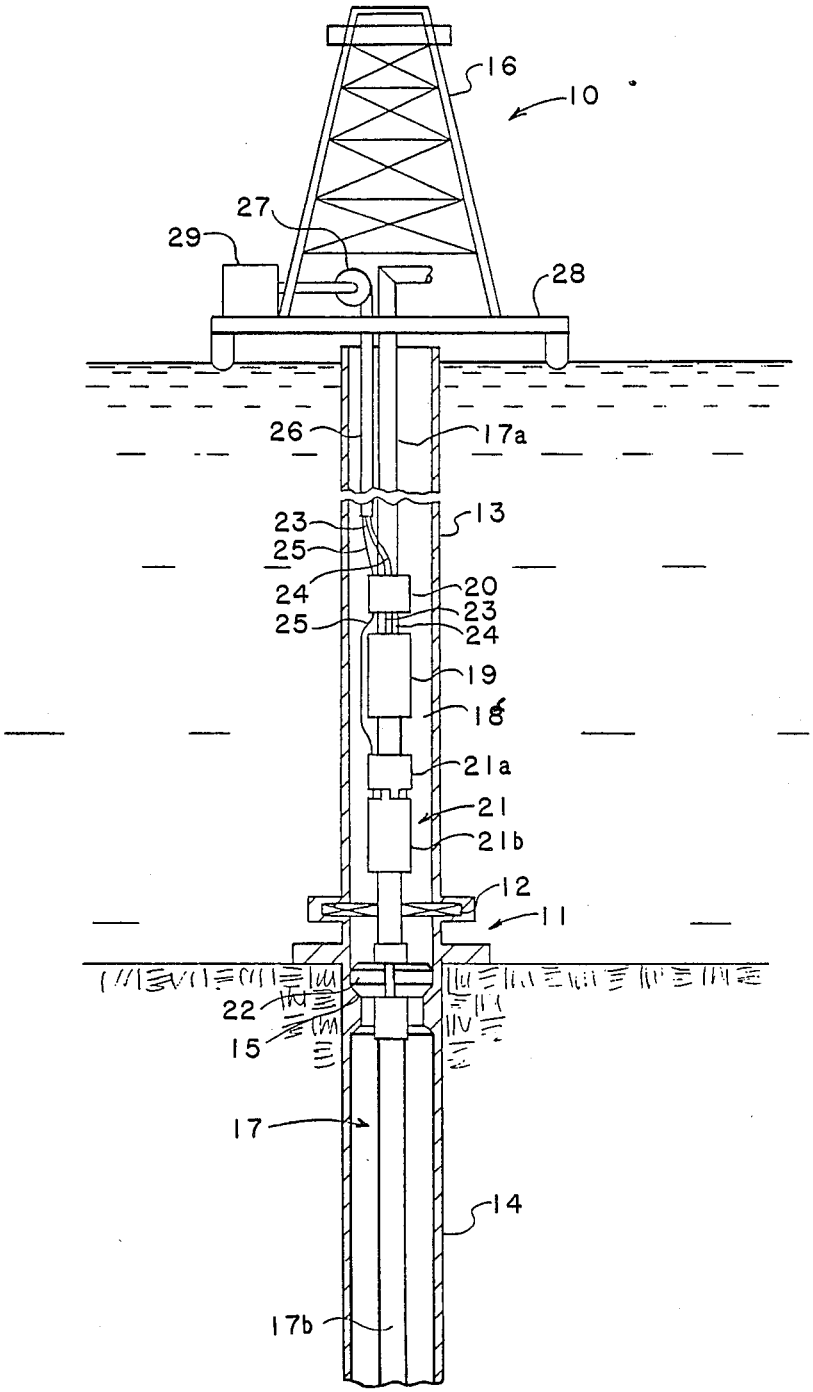
FIG. 1 is a schematic drawing showing an underwater well on which well testing is being performed. The testing equipment includes a retainer valve controlled by the hydraulic control of this invention.

FIG. 1 shows an underwater well on which well tests are being performed. A floating vessel or platform 10 is positioned over an underwater wellhead 11. The wellhead includes a blowout preventer 12 on which is mounted a riser pipe 13. A string of casing 14 extends downwardly from the wellhead into the well bore hole and includes a landing shoulder 15. A derrick 16 on the vessel has been used to lower a string of test pipe 17, having an upper section **17*a* and a lower section 17*b*, into the well forming an annulus 18 between the upper test pipe string and riser pipe. The upper test pipe section includes a retainer valve 19 and a retainer valve control system housing 20**.

The upper section of the test string may be disconnected from the lower test string section by operating subsea test tree 21 to disconnect the upper tree section **21*a* from lower tree section 21*b*** if required during well testing operations.

A fluted hanger 22 has landed on casing landing shoulder 15 and is supporting the weight of the test string and blowout preventer 12 has been closed to seal around the test string.

Control conduits 23, 24 and 25 (if used) are encased in umbilical 26 which is reeled on reel 27 on deck 28 of the vessel. These control conduits are connected into the control system housing and an hydraulic control manifold 29 also on the vessel deck. Conduits 23 and 24 extend from the housing to the retainer valve and conduit 25 may if desired extend from the housing to the subsea test tree. It should be obvious to those skilled in well testing and control system art that the control system could be housed in the retainer valve body and conduits 23 and 24 between the control system housing and the retainer valve would not be required. The control manifold contains pumps, valves, a control fluid reservoir and gauges for providing pressurized fluid in the control conduits and operating the control system and retainer valve as required for testing the well.

Figure 2:
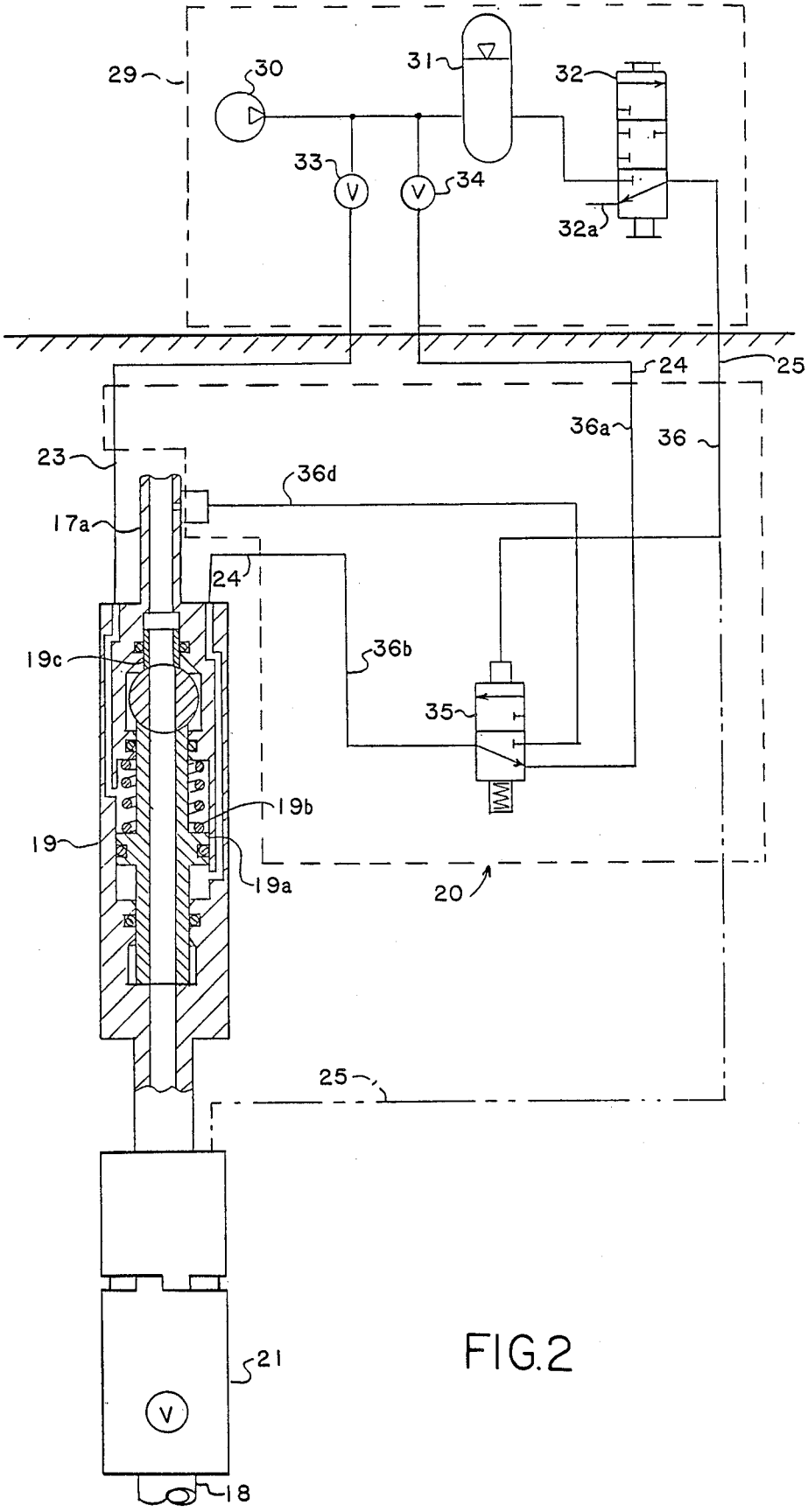
FIG. 2 is a schematic drawing of one embodiment of an hydraulic valve control system of this invention showing the valve open.

FIG. 2 shows schematically an embodiment of the hydraulic system of this invention wherein control manifold 29 includes a pump 30, an accumulator 31 and a directional control valve 32 (shown in the off position). Valve 32 has an outlet **32*a*. The pump is used to pressurize the accumulator and pressure from the pump may be admitted selectively through valve 33 into conduit 23 and the control system for opening retainer valve 19 or through valve 34 into conduit 24** and the control system for closing the retainer valve and sustaining pressure on the closed retainer valve, locking it closed.

Within control system housing 20 is a three-way two-position normally open pilot valve 35 and a number of internal flow passages 36. Conduit 25 extends from the accumulator through the manual shut-off valve in the control manifold and internal flow passages to valve 35 in the control housing. Conduit 25 may be extended from the control housing to a subsea test tree in the test string if desired, to conduct pressurized fluid to the test tree for initiating disconnect of the tree.

Figure 3:
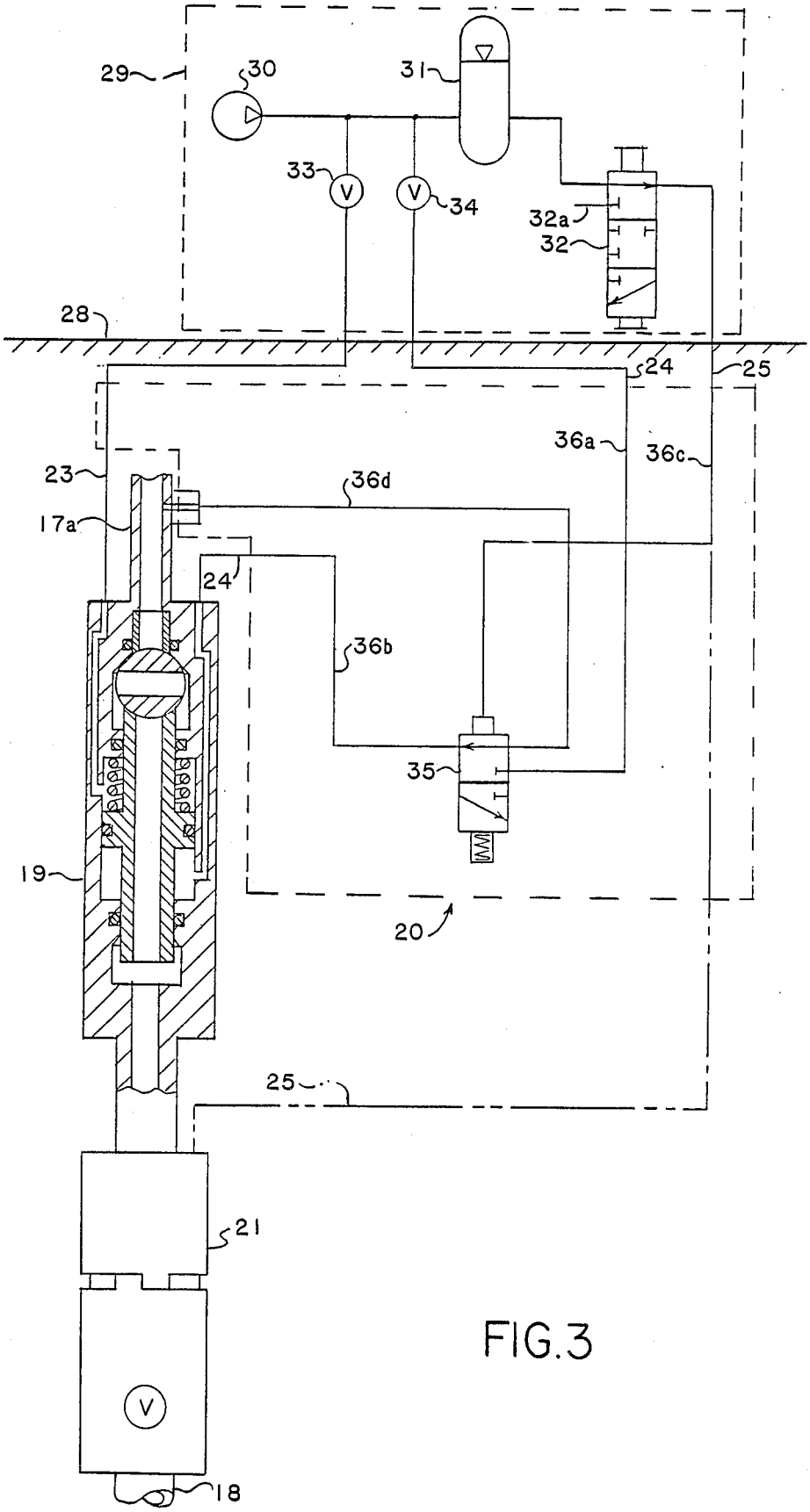
FIG. 3 is a drawing of the control system of FIG. 2, which has been operated to close the valve.

To open retainer valve 19, using the hydraulic control system shown in FIG. 2, the system should be filled with fluid, valves 32, 33 and 34 closed and pump 30 operated to pressurize accumulator 31. To close the retainer valve, pump 30 should be operated and valve 34 opened to pump fluid down possibly very long conduit 24 through housing internal flow passage **36*a*, valve 35 and internal passage 36*b*, back into conduit 24 into and under retainer valve piston 19*a* to move the piston upwardly, compressing retainer valve opening spring 19*b* and closing the valve. Sustained pressure in conduit 24 will hold the retainer valve closed. If quick closure of the retainer valve is desired, directional control valve 32 is pushed to open as shown in FIG. 3, permitting pressurized accumulator 31 to discharge into control conduit 25 and transmit a pressure pulse quickly down to and through control housing passage 36*c* to valve 35. This pressure pulse shifts valve 35 to a position closing internal flow passage 36*a* and connecting flow passage 36*d* from inside upper test string section 17*a* with flow passage 36*b* and conduit 24 between retainer valve 19 and control housing 20**.

Higher well pressure in string section **17*a* now flows a short distance through passage 36*d*, valve 35, passage 36*b* and conduit 24 into the retainer valve and closes the valve. Continuous application of closing pressure on retainer valve piston 19a** will hold or "lock" the retainer valve closed.

If desired, a conduit 25 may be connected between housing internal passage 36c and the subsea test tree so the pressure pulse from the accumulator will not only operate the retainer valve to close but will also ready the subsea test tree for disconnect.

With the retainer valve closed and locked, the subsea test tree may be disconnected and the closed retainer valve will retain pressurized liquids in the test string.

If disconnect is not required, but it is now desirable to pump kill fluids down the test string, pressure in conduit 25 and internal flow passage 36c must be reduced to near zero by positioning valve 32 so pressure may vent through outlet 32a in valve 32.

If subsea test tree disconnect or pumping kill fluids is not required, the retainer valve may be reopened to continue well test operations by positioning valve 32 to reduce conduit 25 and passage 36c. Now, pressurized fluid from pump 30 and/or accumulator 31 should be admitted into control conduit 23 through valve 33 to move retainer valve piston 19a downwardly opening the retainer valve.

Figure 4:
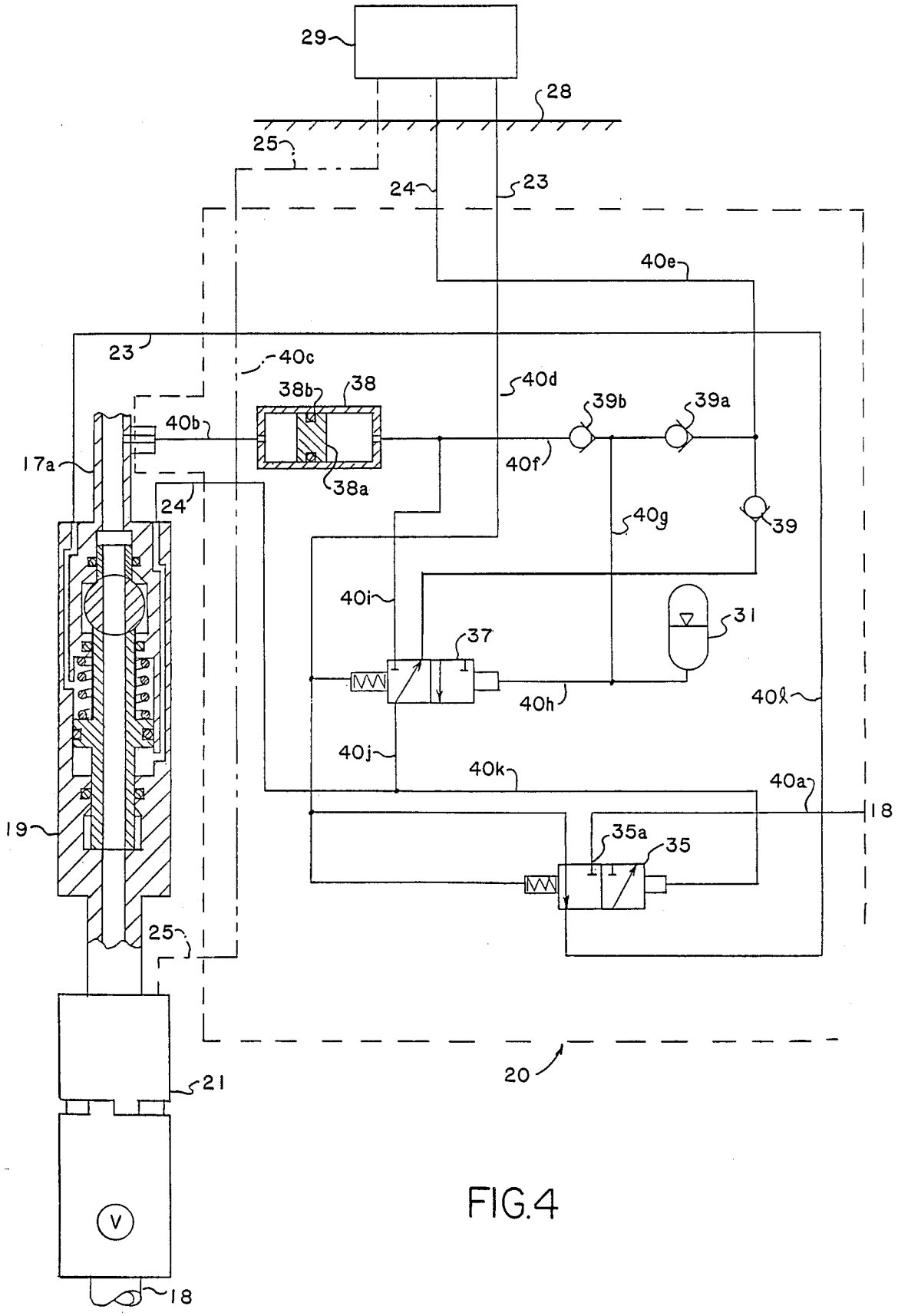
FIG. 4 is a schematic drawing of another embodiment of an hydraulic valve control system of this invention showing the valve open.

Another form of the hydraulic control system of this invention is shown in FIG. 4. This control system is housed in control system housing 20 with conduits 23 and 24 extending from control manifold 29 on the platform deck to the control housing. Control conduits 23 and 24 extend from the control housing to the retainer valve and conduit 25 may if desired extend from the control manifold to subsea test tree 21. In this system, the only purpose conduit 25 serves is to initiate disconnect of the subsea test tree.

Figure 5:
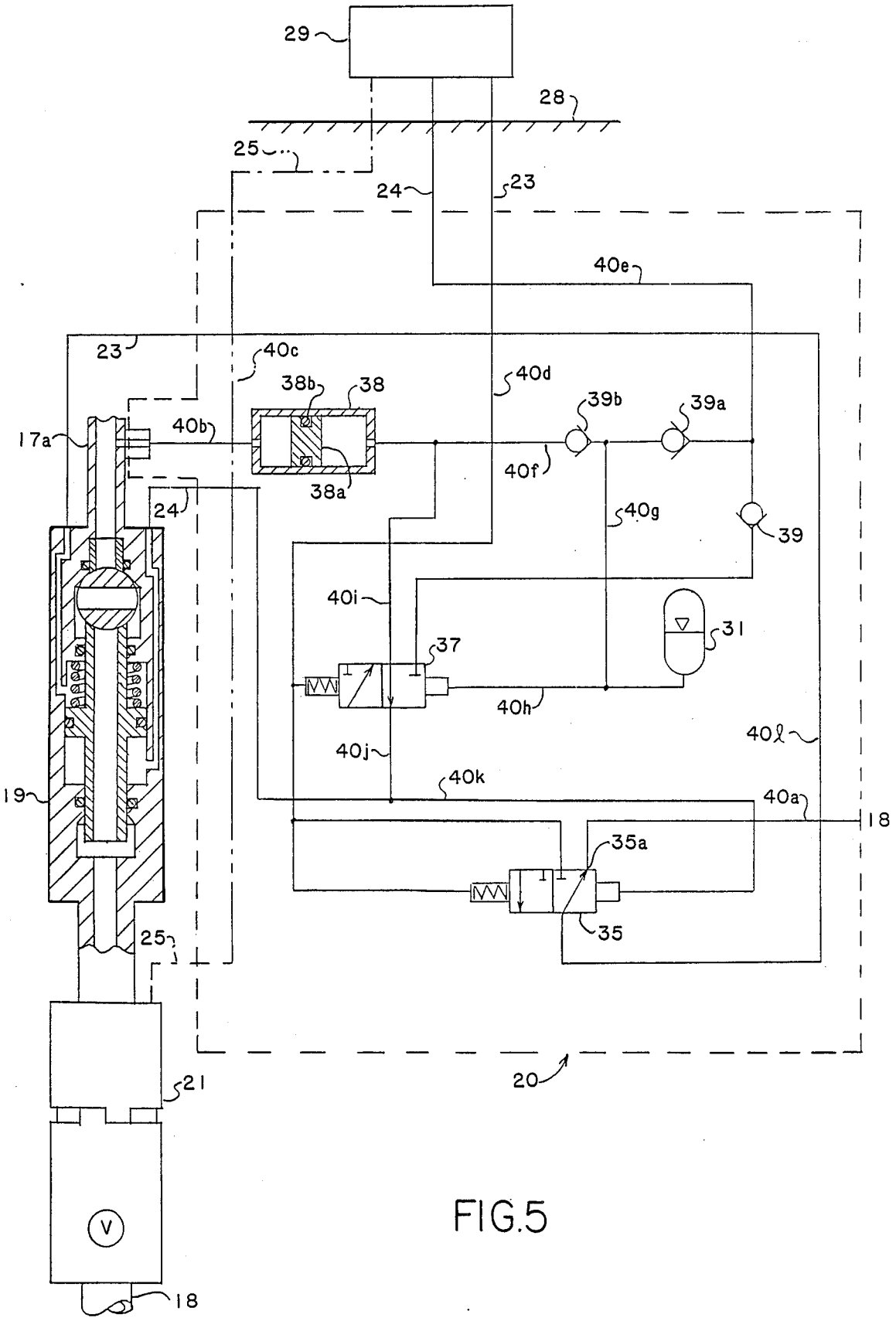
FIG. 5 is a drawing of the control system of FIG. 4, which has been operated to close the valve.

The hydraulic control manifold 29 for this invention form contains a pump, a control fluid reservoir and valves for selectively admitting pressurized fluid into conduits 23, 24 and 25 to operate the control system and retainer valve as required for well testing operations. Pressurizing fluid in conduit 23 on the deck will operate the control system of FIG. 4 to move retainer valve piston 19a downwardly, opening the retainer valve. Pressurizing fluid in conduit 24 will move the retainer valve piston upwardly to close the retainer valve 19 as shown in FIG. 5. Sustained pressure in conduit 24 will retain or lock the retainer valve closed.

Within control system housing 20 of FIG. 4 is a three-way two-position normally open pilot valve 35, a three-way two-position normally closed pilot valve 37, an isolator 38, a small volume accumulator 31, a number of check valves 39 and a number of internal flow passages 40. Valve 35 has an outlet 35a which is in communication with internal passage 40a and the annulus 18 of FIG. 1 exterior of the valve. Internal flow passage 40b communicates between the inside of upper test pipe section 17a and isolator 38. Resilient seal 38b on isolator floating piston 38a sealingly separates control fluid in the control system from well fluid in the test pipe and prevents contamination of the control system fluid by well fluids containing crude hydrocarbons, basic sediments or water. The isolator piston is free to "float" as urged by pressures in internal passages 40b and 40f.

Control conduit 25 may extend, if desired, from control manifold 29 through housing internal passage 40c and conduit 25, from the system housing to the subsea test tree 21, to conduct pressurized fluid to the test tree to initiate disconnecting the tree. Obviously, passage 40c would not be required if conduit 25 is not used.

To open the retainer valve using the control system of FIG. 4, the control system is filled with fluid, pressure is bled from conduit 24 and conduit 23 is pressurized from control manifold 29. This pressure is transmitted through internal passage 40d in system housing 20, to and through pilot valve 35, internal passage 401 and conduit 23 to move piston 19a downwardly opening the retainer valve.

The control system of FIG. 4 may be operated to utilize well pressure in upper test pipe section 17a, when greater than any pressure applied in conduit 24 from control manifold 29, to close the retainer valve when pressure in conduit 23 is bled off. Higher pressure from upper test pipe section 17a in passage 40b has been transmitted through isolator 38 into passage 40f, closing check valve 39b. Control manifold pressure in conduit 24 is now transmitted through internal housing passage 40e into passage 409f, through check valve 39a into passage 40g and passage 40h, charging accumulator 31 and moving pilot valve 37 to open position. Higher pressure in passage 40fmay now cause flow through passage 40i, through open valve 37 into 40j and 40k to the pilot of valve 35, back into conduit 24 and under piston 19a, urging it upwardly toward retainer valve closed position. Pressure on the pilot valve 35 moves valve 35 to a position where any pressure in passage 401 and conduit 23 above piston 19a urging the piston downwardly toward retainer valve open position is exhausted through valve outlet 35a into annulus 18. When pressure in passage 40k and conduit 24 below piston 19a is high enough to overcome spring 19b, piston 19a moves upwardly closing the retainer valve as shown in FIG. 5. Sustained pressure in conduit 24 locks valve 19 closed. If conduit 25 has been extended from control manifold 29 through system housing passage 40c to subsea test tree 21, conduit 25 may be pressurized to initiate disconnect of the test tree and upper string section 17a may be disconnected from lower string section 17b if required.

In a situation where the well pressure in upper test pipe section 17a is zero or less than pressure that can be applied in conduit 24 by control manifold 29 for closing the retainer valve, pressure is bled from conduit 23 and pressure in conduit 24 is transmitted through 40e, into 40f and check valve 39a, into 40g and through check valve 39b, into but not through isolator 38. Pressure in 40g and 40h charges accumulator 31 and moves valve 37 open, permitting pressure from 40f in 40i to flow through open valve 37 into 40j and 40k to conduit 24 and the pilot for valve 35. Pressure in 40k moves valve 35 to a position exhausting pressure in passage 401 and conduit 23 through valve outlet 35a into annulus 18. Pressure in 40k and conduit 24 moves piston 19a upwardly closing the retainer valve.

If desired, the retainer valve may now be reopened by bleeding off pressure in conduit 24 and increasing pressure in conduit 23 at the control manifold. As pressure in conduit 23 approaches the pressure stored in accumulator 31, valve 37 is repositioned closed by pressure from conduit 23 plus spring force, permitting pressure in conduit 24, passages 40k and 40j to flow through valve 37, check valve 39, passage 40e and conduit 24 and be bled off through control manifold 29 on the deck. When pressure in conduit 40k has been reduced to almost equal pressure in conduit 40d, valve 35 is repositioned open, permitting flow from conduit 23 into passage 40d, through the valve into passage 401 and conduit 23 into the retainer valve, urging the piston toward valve open position. Increasing pressure above piston 19*a* and reducing pressure below piston 19*a* has moved the piston downwardly reopening the retainer valve as shown in FIG. 4.

The valve control system of FIG. 4 additionally provides automatic closure for an open retainer valve by well fluids and pressure in the upper test pipe section.

If control conduits 23 and 24 are damaged or cut and pressure in these conduits is reduced to the hydrostatic pressure at depth, lower pressure in conduit 23 permits the charge pressure in accumulator 31 to reposition valve 37 and allows flow from inside upper pipe section 17*a* through passage 40*b* to move isolator piston 38*a* and cause flow into passages 40*f* and 40*i*, through the valve into passages 40*j* and 40*k*, into conduit 24 under piston 19*a* urging the piston upwardly to close the retainer valve. Pressurized fluid in passage 40*k* and valve 35 pilot retains valve 35 in a position so that control fluid displaced by upward movement of the piston may flow through conduit 23, passage 401, valve 35 and be exhausted to annulus 18 through outlet 35*a* and passage 40*a*, as the piston moves upwardly closing the retainer valve and locking the valve closed. The retainer valve will remain closed and locked as long as the pressure in pipe section 17*a* is maintained.

At this time, it may be desirable to pump killing fluid downwardly through the retainer valve and test pipe string into the well to maintain pressure control of the well or control conduits 23 and 24 may be repaired and the retainer valve reopened as previously described.

If pumping killing fluid is desired, pressure in upper pipe section 17*a* must be reduced to permit accumulator 31 to discharge through passages 40*h*, 40*g*, valve 39*b* and passage 40*f* into isolator 38 to reduce pressure in passage 40*h* on valve 37's pilot to allow valve 37's spring to reposition valve 37 closed, so pressure under piston 19*a* may be vented through valve 37, check valve 39, passage 40*e* and conduit 24 to the control manifold.

Now, pressure is increased in upper test pipe section 17*a*. Flow into passage 40*b* cannot induce flow through isolator 38 into passages 40*f* and 40*i* as check valve 39*b* and valve 37 are closed. As the retainer valve controlled by the invention control systems is of the type which may be moved downwardly and rotated to open position when closing pressure acting on piston 19*a* is removed and on application of higher pressure above the closed retainer valve. Increased pressure in upper test pipe section 17*a* to above the pressure in the lower test pipe section acts on the retainer ball valve to move it downwardly and open, permitting killing fluids to be pumped down the upper test pipe section through the retainer valve and down the test pipe string into the well.

After repairing or replacing control conduits 23 and 24, the retainer valve may be reopened as previously described to continue well testing operations.

What we claim is:

1. A system for testing an underwater well, said system comprising:

(a) a test pipe string in said underwater well, said string having an upper section and a lower section;

(b) a hydraulically operated retainer valve in said upper section;

(c) a control system housing in said upper section;

(d) control manifold means for operating said control system and said retainer valve, said control manifold means comprising:

(a) a source of pressure;

(b) a gas charged accumulator;

(c) a directional control valve; and (d) conduits conducting pressurized fluid from said pressure source to said accumulator and from said accumulator to said shut-off valve;

(e) hydraulic control system means in said housing for controlling said retainer valve, said hydraulic control system means conducting well pressure from said test pipe string to said retainer valve for quickly closing said retainer valve and locking said retainer valve closed, said hydraulic control system means comprising:

(a) a normally closed pilot valve;

(b) a flow passage for conducting a pressure pulse from the accumulator to the pilot valve for opening the pilot valve;

(c) a flow passage for conducting fluid from the inside of the test pipe to said pilot valve; and (d) a flow passage for conducting fluid from said pilot valve to said retainer valve for closing said retainer valve and locking said retainer valve closed; and (f) control conduit means for conducting control fluid between said control manifold and said housing and between said housing and said valve.

2. The system of claim 1 further including test tree means in the test pipe string below the retainer valve for disconnecting the upper pipe section from the lower pipe section and a conduit extending between the control manifold and housing and extending between said housing and said tree.

3. The system of claim 1 wherein the pilot valve is a three-way two-position valve.

4. The system of claim 1 wherein the control conduit means comprise:

(a) a conduit for control fluid extending between the control manifold means and the control system housing and between said system housing and the valve, for opening the valve; and (b) a conduit for control fluid extending between said manifold means and said housing and between said housing and said valve, for closing said valve and locking said valve closed.

5. A system for testing an underwater well, said system comprising:

(a) a test pipe string in said underwater well, said string having an upper section and lower section;

(b) a hydraulically operated retainer valve in said upper section;

(c) a control system housing in said upper section;

(d) control manifold means for operating said control system and said retainer valve, said control manifold means including:

(a) a pressure source; and (b) conduits in conjunction with a plurality of valves therein for conducting control fluid to the control system housing;

(e) hydraulic control system means in said housing for controlling said retainer valve, said hydraulic control system means conducting well pressure from said test pipe string to said valve for quickly closing said retainer valve and locking said retainer valve closed, said hydraulic control system means including means for sensing reduced pressure in the upper test pipe section above a closed and locked retainer valve and for unlocking the retainer valve to permit fluids to be pumped through the retainer valve and test pipe into said underwater well, said hydraulic control system means comprising:

(a) a first normally closed pilot valve having a pilot portion associated therewith;

(b) a second normally open pilot valve having a pilot portion associated therewith;

(c) a first pressure source flow passage means for conducting fluid between said first pilot valve and the pressure source;

(d) a first check valve in said first pressure source flow passage means, permitting flow from said first pilot valve to said pressure source;

(e) second retainer valve closing and locking flow passage means for communicating between said first pilot valve and said retainer valve for closing said retainer valve and locking said retainer valve closed;

(f) a first second pilot valve flow passage between said first pilot valve and the pilot portion of said second pilot valve for closing said second pilot valve;

(g) an accumulator;

(h) a second first pilot valve flow passage between said accumulator and said first pilot valve for opening said first pilot valve;

(i) a third first pilot valve flow passage between the interior of upper test pipe section and said first pilot valve, said second first pilot passage and said first pressure source flow passage means for opening said first pilot valve and charging said accumulator;

(j) a second check valve in said third first pilot valve flow passage between said first pilot valve and the pilot portion of said first pilot valve for allowing flow from the pilot portion of said first pilot valve;

(k) a third check valve in said third first pilot valve flow passage between said remote pressure source and said second check valve for allowing flow from said remote pressure source through said first pressure source flow passage means to said second first pilot valve flow passage;

(l) a third multi-flow passage means for communicating between said remote pressure source and the pilot portion of said first pilot valve, said second pilot valve and the pilot portion of said second pilot valve;

(m) fourth retainer valve closing flow passage means for communicating between said second pilot valve and said retainer valve for closing said retainer valve; and (n) a fifth flow passage between said second pilot valve and the exterior of the control system housing; and (f) control conduit means for conducting control fluid between said control manifold and said housing and between said housing and said valve.

6. The system of claim 5 wherein the control system means pilot valves are three-way two-position valves.

7. The system of claim 5 further including test tree means in the test pipe string below the retainer valve for disconnecting the upper pipe section from the lower pipe section and a conduit extending between the control manifold and housing and extending between said housing and said tree.

8. The system of claim 5 wherein the control conduit means comprise:

(a) a conduit for control fluid extending between the control manifold means and the control system housing and between said system housing and the valve, for opening the valve; and (b) a conduit for control fluid extending between said manifold means and said housing and between said housing and said valve, for closing said valve and locking said valve closed.

9. The system of claim 5 wherein the first flow passage means is a flow passage in the control system housing communicating with the first pilot valve and a conduit extending between said housing and the control manifold means.

10. The system of claim 5 wherein the second flow passage means is a flow passage in the housing communicating with the first pilot valve and a conduit extending between said housing and the retainer valve.

11. The system of claim 5 wherein the third flow passage means is a flow passage in the housing communicating with the first and second pilot valve pilots and the second pilot valve and a conduit extending between said flow passage and the control manifold means.

12. The system of claim 5 wherein the fourth flow passage means is a flow passage in the housing communicating with the second pilot valve and a conduit extending between the housing and the retainer valve.

13. The system of claim 5 wherein the control system means further includes an isolator in the third flow passage between the inside of the upper test string section and the second check valve.

14. A hydraulic control system for controlling a retainer valve in a test pipe string having an upper section and lower section in a well, said hydraulic control system comprising:

(a) a control system housing in said test pipe string; and (b) control system means in said housing for conducting pressure from said test pipe string to said valve for quickly closing said retainer valve, said control system means including means for sensing reduced pressure in said test pipe string above a said retainer valve when closed and locked and for locking said retainer valve to allow fluids to be pumped through said retainer valve and said test pipe string into said well, said control system means comprising:

(a) a first normally closed pilot valve having a pilot portion associated therewith;

(b) a second normally open pilot valve having a pilot portion associated therewith;

(c) a remote pressure source;

(d) first remote pressure source flow passage means for conducting fluid between said first pilot valve and said remote pressure source;

(e) a first pressure source check valve in said first flow passage means, allowing flow from said first pilot valve to said pressure source;

(f) second retainer valve closing and locking flow passage means from said first pilot valve to said retainer valve for closing said retainer valve and locking said retainer valve closed;

(g) a first second pilot valve closing flow passage between said pilot valve and the pilot portion of said second pilot valve for closing said second pilot valve;

(h) an accumulator;

(i) a second first pilot valve opening flow passage between said accumulator and the pilot portion of said first pilot valve for opening said first pilot valve;

(j) a third first pilot valve flow passage between the interior of the upper section of said test pipe string in said well and said first pilot valve, said second flow passage and said first flow passage means for opening said first pilot valve and charging said accumulator;

(k) a second sick valve in said third first pilot valve flow passage located between said first pilot valve and the pilot portion of said first pilot valve, allowing flow from the pilot portion of said first pilot valve;

(l) a third check valve in said third first pilot valve flow passage located between said remote pressure source and said second check valve, allowing flow from said pressure source through said first flow passage means to said second flow passage;

(m) a third multi-flow passage means located between said pressure source and the pilot portion of said first pilot valve, said second pilot valve and the pilot portion of said second pilot valve;

(n) fourth retainer valve closing flow passage means located between said second pilot valve and said retainer valve for closing said retainer valve; and (o) a fifth flow passage located between said second pilot valve and the exterior of the control system housing.

15. The control system of claim 14 the pilot valves are three-way, two-position valves.

16. The control system of claim 14 further including an isolator in the third flow passage between the inside of the upper test string section and the second check valve.

17. The control system of claim 14 wherein the first flow passage means is a flow passage in the control system housing communicating with the first pilot valve and a conduit extending between said housing in the control manifold means.

18. The control system of claim 14 wherein the second flow passage means is a flow passage in the housing communicating with the first pilot valve and a conduit extending between said housing and the retainer valve.

19. The control system of claim 14 wherein the third flow passage means is a flow passage in the housing communicating with the first and second pilot valve pilots and the second pilot valve and a conduit extending between said flow passage and the control manifold means.

20. The control system of claim 14 wherein the fourth flow passage means is a flow passage in the housing communicating with the second pilot valve and a conduit extending between the housing and the retainer valve.

* * * * *

UNITED STATES PATENT AND TRADEMARK OFFICE

CERTIFICATE OF CORRECTION

PATENT NO. : 4,880,060

DATED : November 14, 1989

INVENTOR(S) : Kenneth L. Schwendemann et al

It is certified that error appears in the above-identified patent and that said Letters Patent is hereby corrected as shown below:

In Column 6, Line 18, change the number "409f" to the number -- 40f --.

Signed and Sealed this

Fifteenth Day of September, 1992

*Attest:*

DOUGLAS B. COMER

*Attesting Officer*

*Acting Commissioner of Patents and Trademarks*